US008801119B2

(12) United States Patent
Huang

(10) Patent No.: US 8,801,119 B2
(45) Date of Patent: Aug. 12, 2014

(54) ADJUSTABLE SLIDE LATCH DEVICE

(75) Inventor: Kuo-Sheng Huang, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 112 days.

(21) Appl. No.: 13/481,626

(22) Filed: May 25, 2012

(65) Prior Publication Data

US 2012/0301062 A1 Nov. 29, 2012

(30) Foreign Application Priority Data

May 27, 2011 (TW) ..... 100209585 U

(51) Int. Cl.
*A47B 88/04* (2006.01)

(52) U.S. Cl.
CPC ..... *A47B 88/04* (2013.01); *A47B 2210/0018* (2013.01)
USPC ..... 312/333

(58) Field of Classification Search
USPC ..... 312/330.1, 333, 334.1, 334.7, 334.8, 312/334.11, 334.44, 334.46, 334.47; 384/21, 22
See application file for complete search history.

(56) References Cited

U.S. PATENT DOCUMENTS

| | | | | |
|---|---|---|---|---|
| 4,469,384 | A * | 9/1984 | Fler et al. | 312/333 |
| 5,181,782 | A * | 1/1993 | Wojcik | 384/21 |
| 6,497,464 | B1 | 12/2002 | Cammack et al. | |
| 7,628,460 | B1 * | 12/2009 | Huang | 312/333 |
| 8,528,998 | B2 * | 9/2013 | Leal | 312/333 |
| 2006/0043851 | A1 * | 3/2006 | Lee | 312/333 |
| 2006/0082267 | A1 * | 4/2006 | Lin | 312/333 |
| 2008/0303399 | A1 * | 12/2008 | Huang et al. | 312/334.46 |

* cited by examiner

*Primary Examiner* — James O Hansen
(74) *Attorney, Agent, or Firm* — Muncy, Geissler, Olds & Lowe, P.C.

(57) ABSTRACT

An adjustable slide latch device has a slide track unit comprising an outer track and an extendable and retractable inner track held in the outer track, both are collectively provided with (a) a stopper device comprising a stopper piece and an adjustment piece and (b) a limit piece at laterals: the stopper piece disposed at the surface of the inner track comprises base parts which are fixed on the inner track and have (1) equidirectional-extended support arms at both laterals on which there are thrust blocks at rear ends and (2) positioning parts between two support arms; the adjustment piece which is disposed at the stopper piece's other lateral away from inner track and has a pivot part joining the positioning parts can drive two support arms during rotation to adjust space between thrust blocks at two support arms' rear ends and change forces to open and close a drawer.

7 Claims, 10 Drawing Sheets

ADJUSTABLE SLIDE LATCH DEVICE

BACKGROUND OF THE INVENTION

1) Field of the Invention

The present invention relates to an adjustable slide latch device, particularly a stopper device which is effective in stopping combined tracks.

2) Description of the Prior Art

Cabinet drawers have been extensively applied in various storage implements. To realize a cabinet drawer which is conveniently pulled out, those tracks with functions for positioning and guidance are usually integrated into a cabinet drawer's both laterals. For stable close of a cabinet drawer, the design of tracks is intended for positioning a cabinet drawer, which has been completely pushed in, by positioning devices without automatically outward slide of the drawer; the cabinet drawer cannot be tightly held by the positioning devices or a user will feel obstructive by applying a larger force. However, the various positioning devices on tracks designed to match all types of cabinet drawers which have distinct weights attributed to different volumes or materials have burdened a manufacturer with increased costs and inventories via designs of different tracks for specific drawers. In addition, those positioning devices may fail when weights of objects held in a cabinet drawer are out of the upper limit of loads born by the positioning devices on tracks Accordingly, it has become one issue of persons skilled in the arts to solve problems and shortcomings out of prior arts.

SUMMARY OF THE INVENTION

The present invention is intended for using a stopper device on slide tracks to adjust forces which are applied to open or close a drawer based on weight born by the drawer for a user's convenient usage and a manufacturer's reduced costs of production and inventories.

To achieve this purpose, the present invention of an adjustable slide latch device has a slide track unit comprising an outer track and an extendable and retractable inner track held in the outer track, both of which are collectively provided with (a) a stopper device comprising a stopper piece and an adjustment piece and (b) a limit piece at their same laterals: the stopper piece disposed at the surface of the inner track comprises base parts which are fixed on the inner track and have (1) equidirectional-extended support arms at their both laterals on which there are thrust blocks at rear ends and (2) positioning parts between the two support arms; the adjustment piece which is disposed at the stopper piece's other lateral away from the inner track and has a pivot part joining the positioning parts can drive the two support arms during rotation to adjust a spacing between the thrust blocks at the two support arms' rear ends and change forces which are applied to open and close a drawer.

DETAILED DESCRIPTIONS OF THE PREFERRED EMBODIMENTS

Referring to FIG. 1 through FIG. 4 which clearly illustrate the present invention of an adjustable slide latch device comprising a slide track unit 1, a stopper device 2 and a limit piece 3: the slide track unit 1 is provided with an outer track 11 and an inner track 12 extending from or held in the outer track 11.

The stopper device 2 is installed on one lateral of the inner track 12 and is provided with a stopper piece 21, an adjustment piece 22 and a fixing piece 23. The stopper piece 21 disposed at the surface of the inner track 12 has a first base part 2111 and a second base part 2121, each of which allows its flanks fixed between both laterals of the inner track 12, wherein the first base part 2111 and the second base part 2121 are respectively provided with an equidirectional-extended support arm 2112 and 2122 which comprises thrust block 2113 and 2123 at its rear end as well as a raised stopper rib 2114 and 2124 at its relative flank and a positioning part 2115 and 2125 located between two support arms 2112, 2122 and joining a pivot joint 2116 and 2126 at its surface. The adjustment piece 22 disposed at the other flank of the stopper piece 21 away from the inner track 12 comprises a pivot part 221 which is provided with a pivotal hole 2211 joining peripheries of the pivot joints 2116, and 2126, a drive part 223 surrounding the pivot part 221 and connecting raised drive blocks 224, and opposite-arranged ribs 222 protruding from the peripheral edge of the pivot part 221 and facing the stopper ribs 2114, and 2124 on the stopper piece 21. The fixing piece 23 penetrating the pivot joints 2116, 2126 is fixed in the inner track 12.

The limit piece 3 manufactured with a resilient material is disposed at the same ends of both the outer track 11 and the stopper device 2 and is provided with a fixing part 31 fastened on the surface of the outer track 11 and comprising two limit arms 32 at corresponding facets, each of which has a bump 33 opposite to the other bump 33 at its rear end surface wherein the bump 33 has guide surfaces 331, 331' along the extensive direction of the limit arm 32.

Referring to FIG. 3 through FIG. 7 which clearly illustrate the clockwise rotating drive block 224 of the adjustment piece 22 allows the adjustment piece 22 to turn with the pivot joints 2116, 2126 on the stopper piece 21 and the stopper ribs 2114, 2124 of the stopper piece 21 to be driven by the ribs 222 of the adjustment piece 22 for the purpose of reversely moving the two support arms 2112, 2122 and opening the thrust blocks 2113, 2123 at rears ends of the support arms 2112, 2122 to a width depending on positions of the ribs 222; the stopper ribs 2114, 2124 of the stopper piece 21 are driven by the ribs 222 of the adjustment piece 22 on which the drive blocks 224 are reversely rotated so that the two support arms 2112, 2122 moving relatively make the thrust blocks 2113, 2123 at rear ends of the support arms 2112, 2122 close by referring to positions of the ribs 222; additionally, the ribs 222 of the adjustment piece 22 which stops rotation are fixed and positioned between the stopper ribs 2114, 2124 due to opposite arrangement of the raised stopper ribs 2114, 2124.

Referring to FIGS. 2, 3, 7 and 8. It can be clearly seen from FIGS. 7 and 8 that the thrust blocks 2113, 2123 at rear ends of the two support arms 2112, 2122 of the stopper piece 21 are held between the two limit arms 32 of the limit piece 3 when the inner track 12 retracts toward the outer track 11. In virtue of the width of the two thrust blocks 2113, 2123 greater than the distance between the bumps 33 on the two limit arms 32, the two thrust blocks 2113, 2123, which confront resistances of the bumps 33 and move relatively while entering a space between the two limit arms 32 and passing through the bumps 33, drive the support arms 2112, 2122 to be resiliently deformed first but resume their original states because of bounce from the resiliently deformed support arms 2112, 2122 and no resistances of the bumps 33 which was crossed by the thrust blocks 2113, 2123. Similarly, the resiliently deformed support arms 2112, 2122 allow the thrust blocks 2113, 2123 to cross the bumps 33 again and protrude from the two limit arms 32 when the inner track 12 extends outside the outer track 11. Furthermore, each of the bumps 33 is provided with the guide surfaces 331, 331' at two laterals of the limit arm 32 by which the thrust blocks 2113, 2123 smoothly cross the bumps 33.

Referring to FIGS. 9 and 10 which clearly illustrate the stopper piece 21 of the present invention is composed of two relatively arranged components, a first stopper piece 211 and a second stopper piece 212, wherein the first stopper piece 211 comprises the first base part 2111 with a mounting hole 2117 at the first base part's 2111 side and the second stopper piece 212 comprises the second base part 2121 with a dowel pin 2127 at the second base part's 2121 side used in engaging the mounting hole 2117 to complete positioning.

As one solution to overcome shortcomings of prior arts, the present invention with critical techniques relies on the rotational adjustment piece 22 in order to realize (a) the stopper ribs 2114, 2124 of the stopper piece 21 are driven by the ribs 222 of the adjustment piece 22 and (b) the thrust blocks 2113, 2123 cross the bumps 33 for completing either positioning or separation because of the changeable width between the thrust blocks 2113, 2123 which makes the two support arms 2112, 2122 resiliently deformed by means of different external forces during attachment or separation between the outer track 11 and the inner track 12 of the slide track unit 1. Thus, a force necessary to open or close a drawer is adjustable for convenient usage by referring to states of a removable cabinet drawer or weight born by a drawer during reinstallation of the slide track unit 1. On the other hand, a manufacturer's costs and inventories for production of the slide track unit 1 in the present invention applicable to drawers opened or closed by different forces can be reduced.

BRIEF DESCRIPTIONS OF THE DRAWINGS

Figure 1:
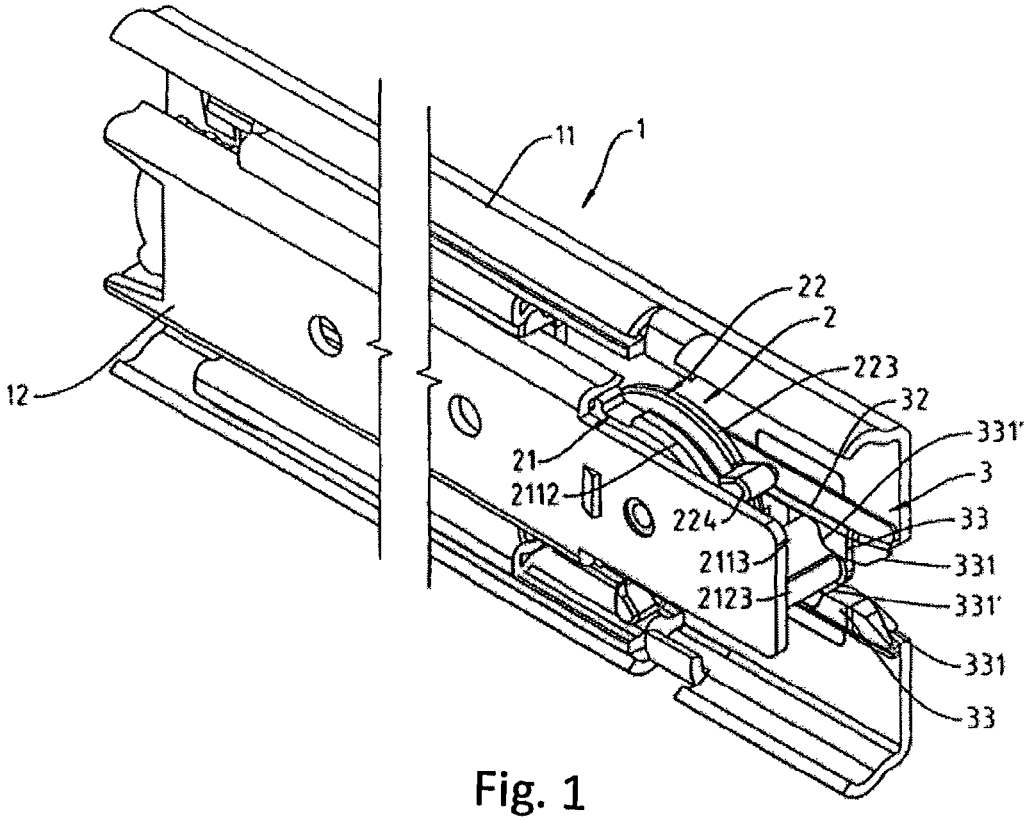
FIG. 1 is the perspective view (1) of the present invention.
Figure 2:
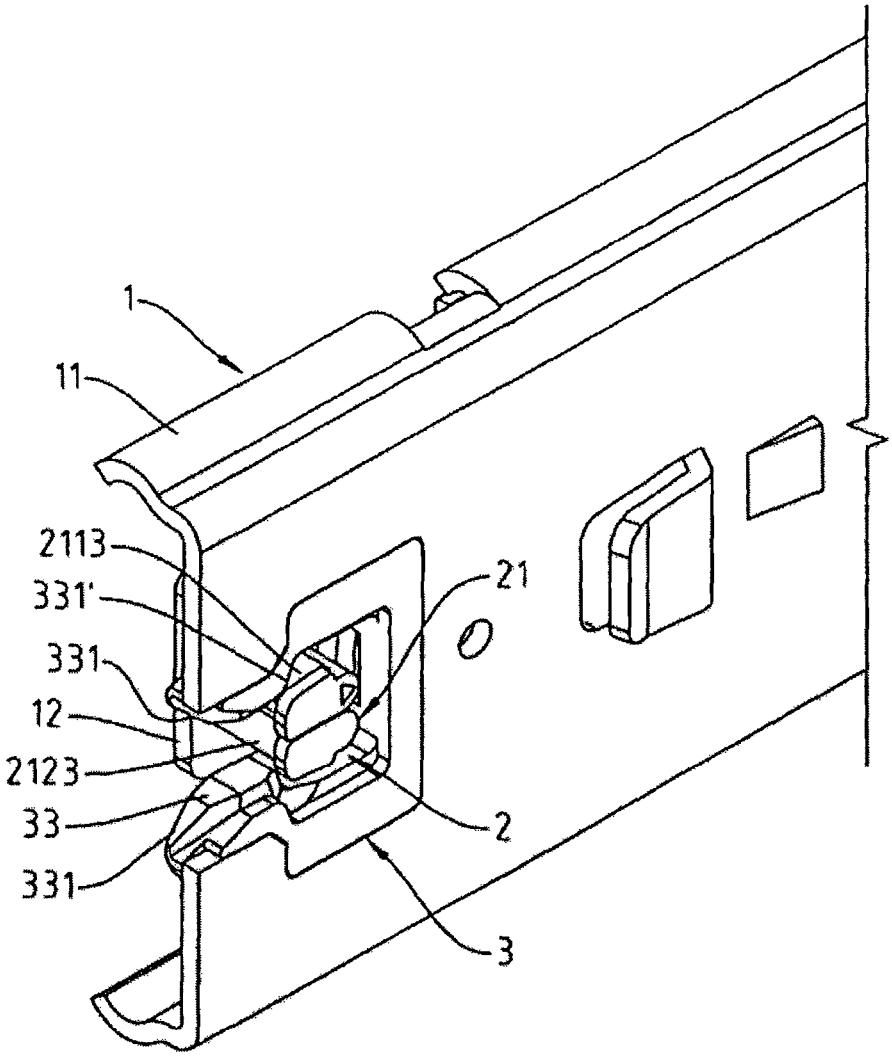
FIG. 2 is the perspective view (2) of the present invention.
Figure 3:
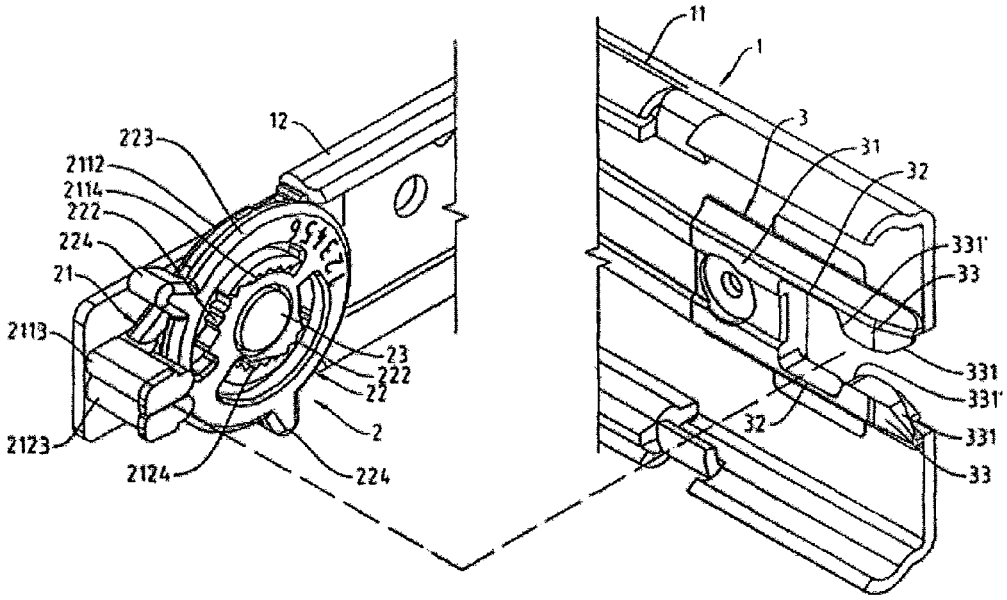
FIG. 3 is the exploded perspective view of the present invention.
Figure 4:
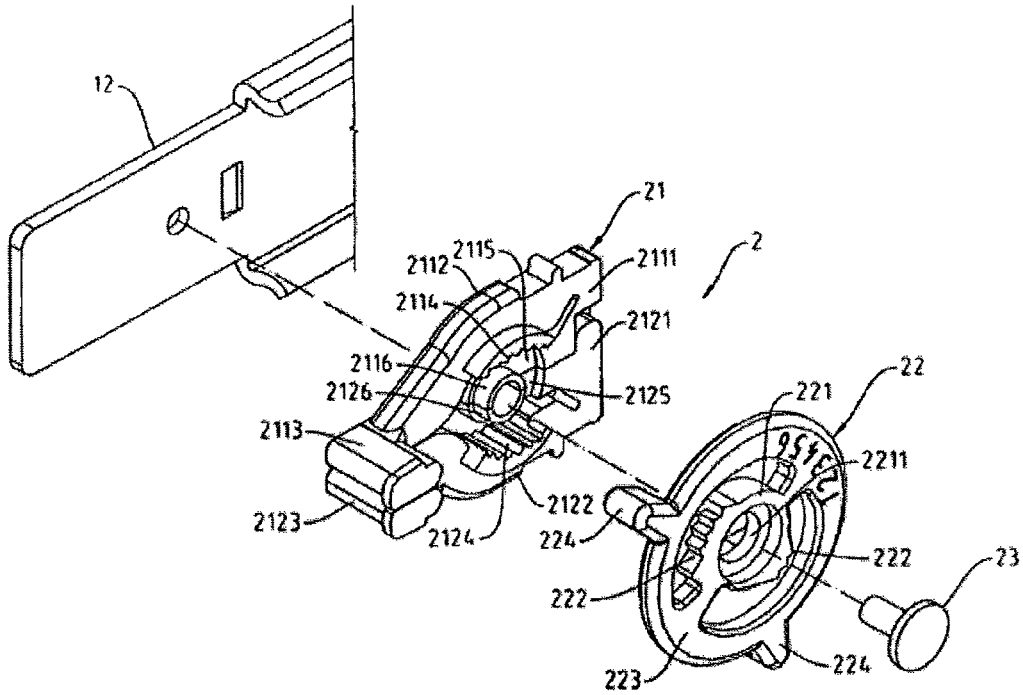
FIG. 4 is the partial exploded perspective view (1) of components in the present invention.
Figure 5:
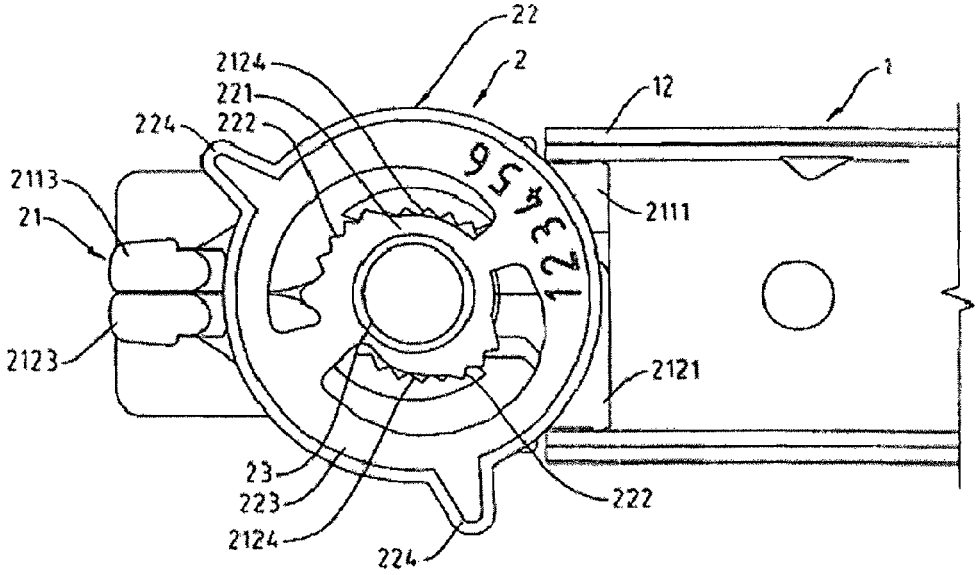
FIG. 5 is the schematic illustration (1) for motion of the adjustment piece in the present invention.
Figure 6:
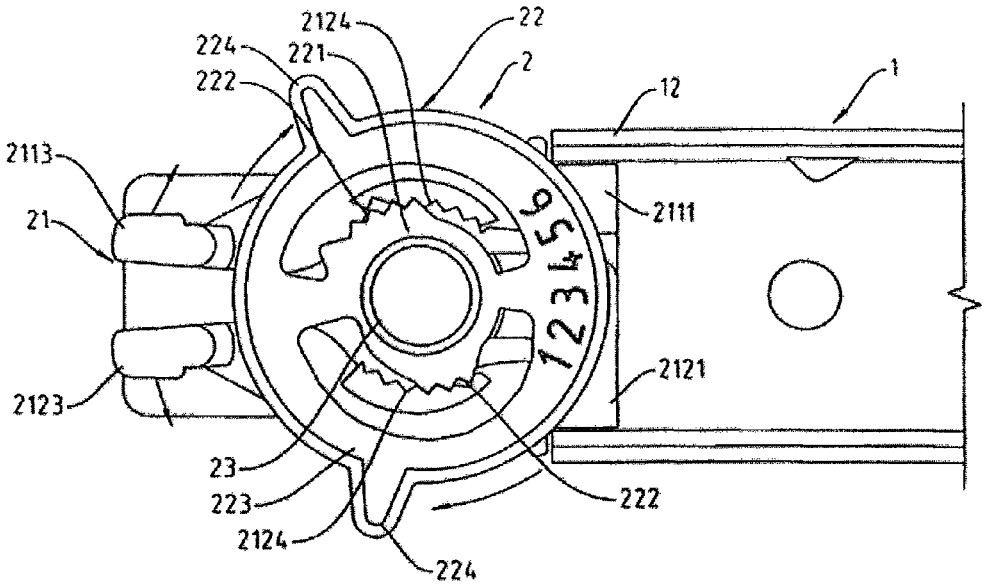
FIG. 6 is the schematic illustration (2) for motion of the adjustment piece in the present invention.
Figure 7:
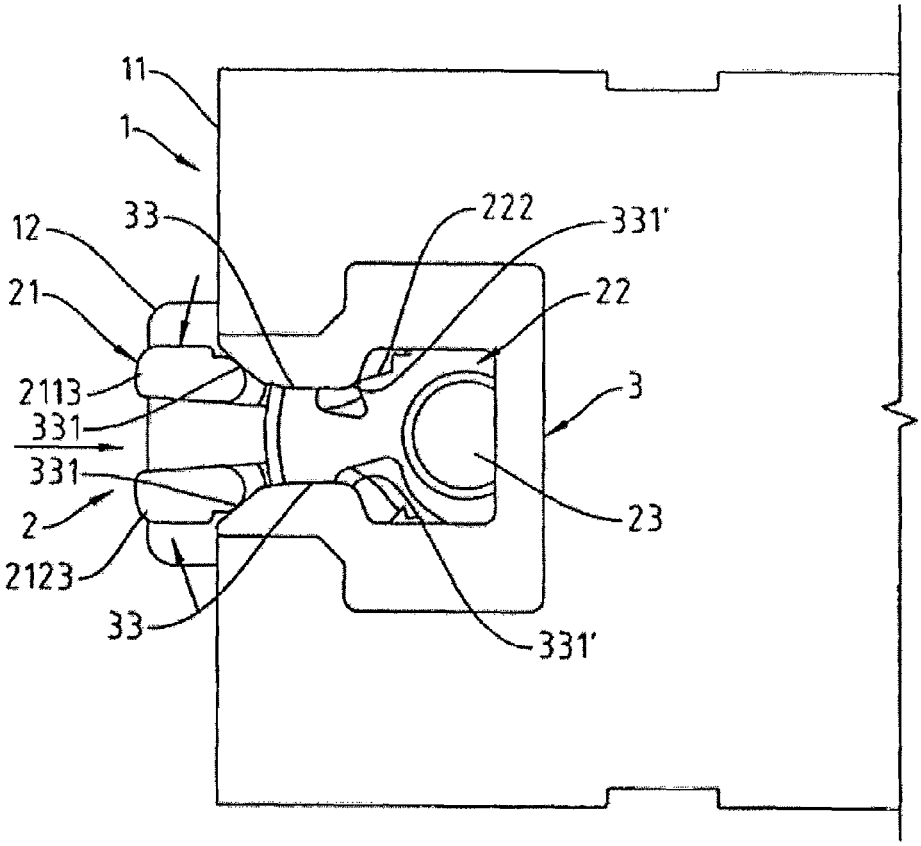
FIG. 7 is the schematic illustration (1) for retracted tracks of the present invention.
Figure 8:
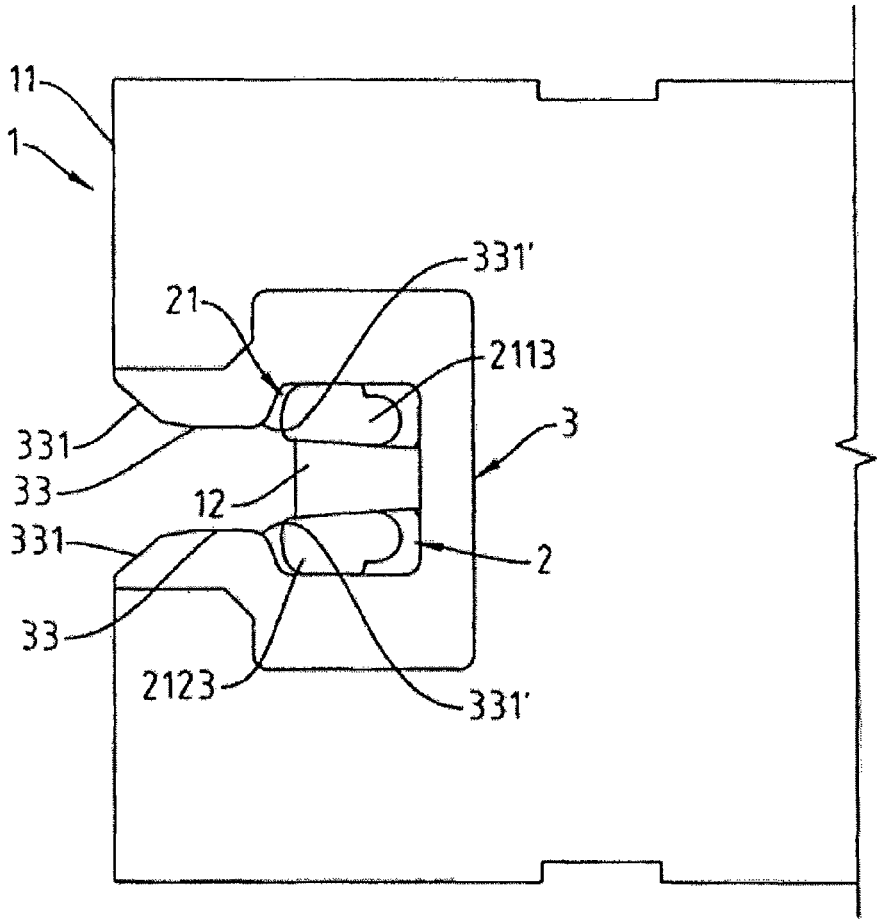
FIG. 8 is the schematic illustration (2) for combination of tracks in the present invention.
Figure 9:
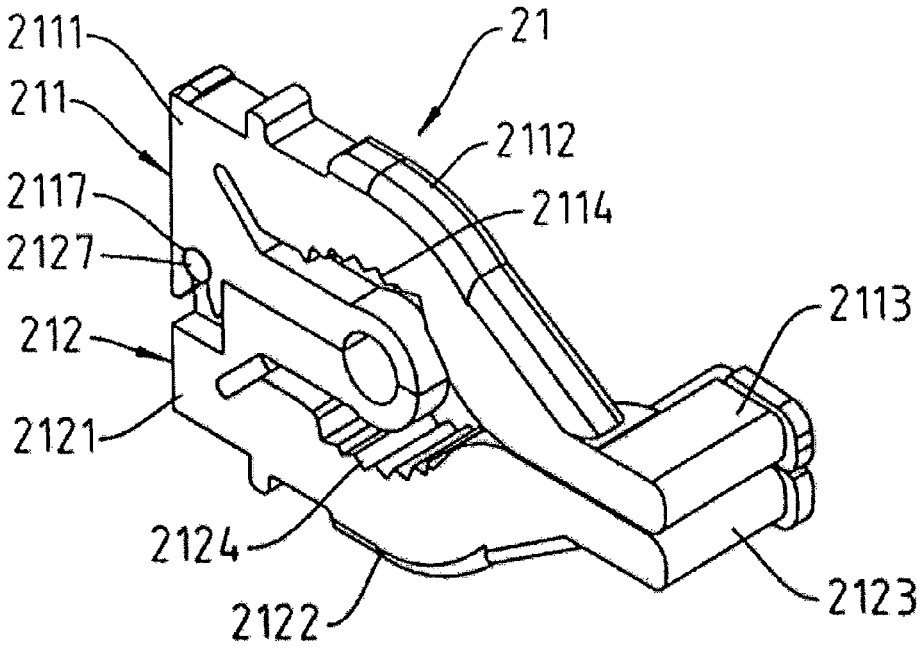
FIG. 9 is the perspective view of the stopper piece in the present invention.
Figure 10:
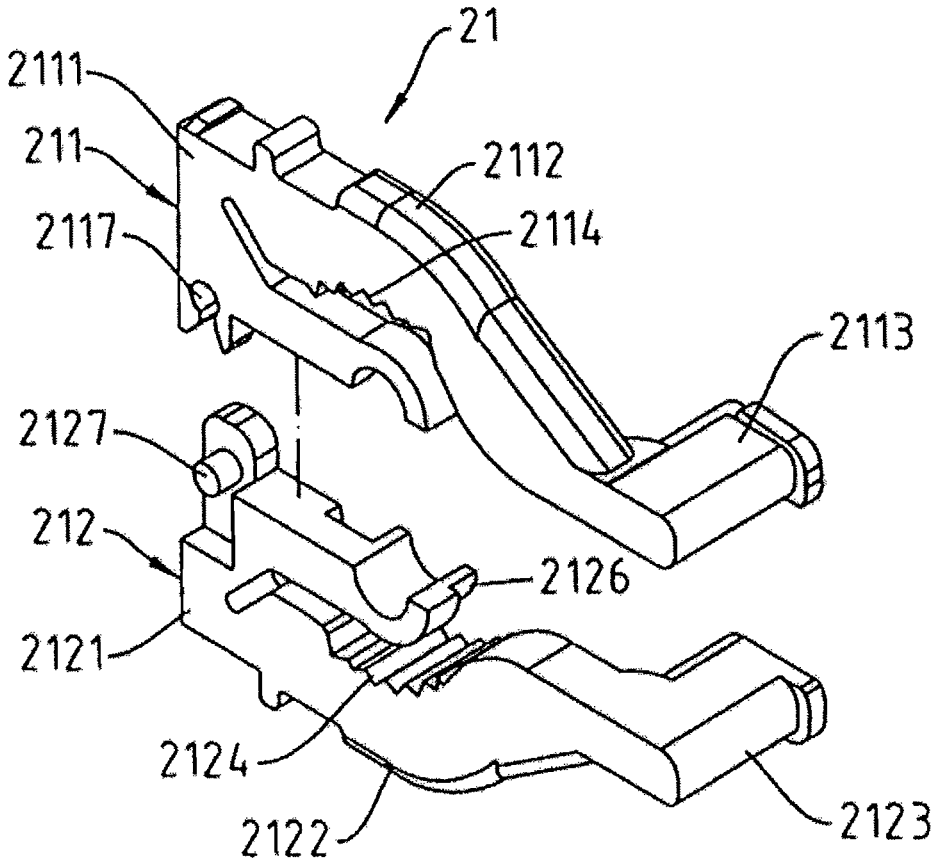
FIG. 10 is the exploded perspective view of the stopper piece in the present invention.

What is claimed is:

1. An adjustable slide latch device comprising:

a slide track unit with an outer track and an extendable and retractable inner track held in the outer track, a stopper device provided with a stopper piece and an adjustment piece, and a limit piece, wherein the stopper device and the limit piece are disposed at the same side of the inner track and the outer track, and the stopper device stops the limit piece when the two tracks are combined together, wherein the stopper piece is disposed on the surface of the inner track and has a first base part and a second base part, which allows both sides of the first base part and the second base part to be fixed between upper and lower sides of the inner track and have equidirectional-extended support arms comprising thrust blocks developed at rear ends and opposite-arranged raised stopper ribs on corresponding side surfaces and positioning parts between the two support arms at one side of the first base part and the second base part, and the stopper piece is composed of a first stopper piece and a second stopper piece engaging relatively, the first stopper piece has the first base part with a mounting hole at the side of the first base part, and the second stopper piece has the second base part with a dowel pin at the side of the second base part which engages the mounting hole for positioning;

wherein the adjustment piece is disposed on the other side of the stopper piece away from the inner track, and comprises a pivot part joining the positioning parts of the stopper piece and provided with ribs oppositely arranged on its peripherals wherein the ribs are used to drive the stopper ribs of the stopper piece and adjust a spacing between the thrust blocks at the rear ends of the two support arms during rotation of the adjustment piece.

2. The adjustable slide latch device according to claim 1 wherein the adjustment piece is provided with a drive part which is located around the pivot part and has raised drive blocks.

3. The adjustable slide latch device according to claim 1 wherein the stopper piece has the positioning parts on which there are raised pivot joints and the adjustment piece has the pivot part on which there are pivotal holes joining the pivot joints' peripheral edges.

4. The adjustable slide latch device according to claim 1 wherein the stopper piece has the positioning parts on which there are raised pivot joints, the adjustment piece has the pivot part on which there are pivotal holes used to join the pivot joints' peripheral edges, and the stopper device is provided with a fixing piece which penetrates the pivot joints and is fixed in the inner track.

5. The adjustable slide latch device according to claim 1 wherein the limit piece is provided with a fixing part comprising limit arms at both flanks in which the thrust blocks of the stopper piece are held as the inner track is retracted in the outer track.

6. The adjustable slide latch device according to claim 5 wherein the fixing part's two limit arms are provided with bumps on surfaces of corresponding flanks and each of the bumps is provided with guide surfaces at two lateral edges along the extended limit arm.

7. The adjustable slide latch device according to claim 5 wherein the limit piece is manufactured with a resilient material.

* * * * *